US010947635B2

(12) United States Patent
Yoo

(10) Patent No.: US 10,947,635 B2
(45) Date of Patent: Mar. 16, 2021

(54) SURFACE TREATMENT METHOD FOR ALUMINUM EXTERIOR PART OF VEHICLE

(71) Applicants: HYUNDAI MOTOR COMPANY, Seoul (KR); KIA MOTORS CORPORATION, Seoul (KR)

(72) Inventor: Chang-Yeol Yoo, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 12 days.

(21) Appl. No.: 16/454,971

(22) Filed: Jun. 27, 2019

(65) Prior Publication Data

US 2020/0181793 A1 Jun. 11, 2020

(30) Foreign Application Priority Data

Dec. 10, 2018 (KR) ..... 10-2018-0158116

(51) Int. Cl.

| | |
|---|---|
| ***C23C 28/00*** | (2006.01) |
| ***C25D 11/16*** | (2006.01) |
| ***C23F 17/00*** | (2006.01) |
| ***C23C 28/04*** | (2006.01) |
| ***C23C 26/00*** | (2006.01) |

(52) U.S. Cl.

CPC ..... *C25D 11/16* (2013.01); *C23C 26/00* (2013.01); *C23C 28/04* (2013.01); *C23F 17/00* (2013.01)

(58) Field of Classification Search

CPC ..... C23C 28/00
USPC ..... 205/188, 205, 213
See application file for complete search history.

(56) References Cited

U.S. PATENT DOCUMENTS 2,859,148 A * 11/1958 Altenpohl ..... C25D 3/12 148/275
3,963,568 A * 6/1976 Nikaido ..... C09D 5/448 428/472.2

(Continued)

FOREIGN PATENT DOCUMENTS

CN 101265604 A * 9/2008 ..... C25D 13/00
CN 104233273 A * 12/2014 ..... C23C 22/56

(Continued)

OTHER PUBLICATIONS

Brunger et al., "Al—Mg—Si sheet Alloys for Autobody Applications," Virtual Fabrication of Aluminium Products: Microstructural Modeling in Industrial Aluminum Fabrication Processes Wiley-Vch Verlag Gmbh & Co, Weinheim (2006), pp. 51-63. (Year: 2006).*

*Primary Examiner* — Edna Wong
(74) *Attorney, Agent, or Firm* — Morgan, Lewis & Bockius LLP

(57) ABSTRACT

A surface treatment method for an aluminum exterior part of a vehicle includes: pre-treating the aluminum exterior part comprising aluminum or an aluminum alloy; etching a surface of the pre-treated aluminum exterior part by immersing the pre-treated aluminum exterior part in an etching solution; forming an oxide layer on the surface of the aluminum exterior part by immersing the aluminum exterior part, which is subjected to the etching, in a hydrothermal synthetic solution; and forming an electrodeposition coating layer on the surface of the aluminum exterior part, which is subjected to the forming the oxide layer.

10 Claims, 11 Drawing Sheets

(56) References Cited

U.S. PATENT DOCUMENTS

| | | | | |
|---|---|---|---|---|
| 2004/0067839 | A1* | 4/2004 | Nawa | C04B 35/4885<br>501/105 |
| 2010/0072584 | A1* | 3/2010 | Aruga | C22C 9/00<br>257/666 |

FOREIGN PATENT DOCUMENTS

| | | | | | |
|---|---|---|---|---|---|
| CN | 108149081 | A | * | 6/2018 | C09D 4/00 |
| KR | 10-2008-0083857 | A | | 9/2008 | |

* cited by examiner

SURFACE TREATMENT METHOD FOR ALUMINUM EXTERIOR PART OF VEHICLE

CROSS-REFERENCE TO RELATED APPLICATION

This application claims priority to Korean Patent Application No. 10-2018-0158116, filed on Dec. 10, 2018 in the Korean Intellectual Property Office, which is incorporated herein by reference in its entirety.

TECHNICAL FIELD

The present disclosure relates a surface treatment method for an aluminum exterior part of a vehicle, and more particularly, to a surface treatment method for treating a surface of an exterior part of the vehicle formed from aluminum material to provide an excellent adhesive property and corrosion resistance of a coating layer.

BACKGROUND

Generally, due to strong oxidizing power of aluminum in air at a room temperature, white rust substance such as aluminum hydroxide ($Al(OH)_3$) is created on a surface of an exterior part for a vehicle made of aluminum material. However, there is a problem that local pitting corrosion or cracking is caused under unfavorable condition such as de-icing salt due to exposure to an external environment. To solve this described problem, a coating process is performed on a surface of the aluminum exterior part for a vehicle.

In a conventional surface treatment method for an aluminum exterior part of a vehicle, as shown in FIG. 1, an oxide film that is an aluminum oxide ($Al_2O_3$) layer is formed on an aluminum surface of a pre-treated aluminum exterior part through an anodizing treatment method, and such the oxide film has a wider surface area to increase an adhesive property (contacting force) to a coating layer in a subsequent process, and thus form a coating layer on the surface of the aluminum exterior part.

However, when the conventional anodizing treatment method is employed, there is a problem that an adhesive property (contacting force) to the coating layer is lowered on the surface of the aluminum exterior part as time passed. In addition, the conventional anodizing treatment method has the disadvantages that a work space and equipments such as a separate tank and a high-voltage current device, etc., required for performing the anodizing treatment method are required and a treatment process also takes more than 20 minutes.

Therefore, in the surface treatment of the aluminum exterior part for a vehicle, the adhesion to the coating layer is continuously maintained, and in the surface treatment process, it is required to improve the method for productivity, work efficiency improvement, and production cost reduction effect.

SUMMARY OF THE DISCLOSURE

The technical object to be achieved by the present disclosure is to provide a surface treatment method for an aluminum exterior part of a vehicle, which treats a surface of the aluminum exterior part of a vehicle using hydrothermal synthesis to enhance corrosion resistance and an adhesive property, eliminate the need for additional equipment, and to shorten a process time to, e.g., 10 minutes or less, as compared with the conventional anodizing treatment method.

According to an exemplary embodiment of the present disclosure, a surface treatment method for an aluminum exterior part of a vehicle may include: pre-treating the aluminum exterior part comprising aluminum or an aluminum alloy; etching a surface of the pre-treated aluminum exterior part by immersing the pre-treated aluminum exterior part in an etching solution; forming an oxide layer on the surface of the aluminum exterior part by immersing the aluminum exterior part, which is subjected to the etching, in a hydrothermal synthetic solution; and forming an electrodeposition coating layer on the surface of the aluminum exterior part, which is subjected to forming the oxide layer.

In the etching, the aluminum exterior part may be put into and immersed in the etching solution at a temperature of 15 to 30° C. for 1 to 10 minutes.

The etching solution is a solution in which water and sulfuric acid ($H_2SO_4$) are mixed in the volume ratio of 3:1. In addition, the etching solution may have concentration of 30 to 40 wt %.

In forming the oxide layer, the aluminum exterior part, which is subjected to the etching, may be put into and immersed in the hydrothermal synthetic solution at a temperature of 90 to 100° C. for 1 to 10 minutes.

The hydrothermal synthetic solution may be a solution containing zirconium nitrate ($Zr(NO_3)_4$) of 0.1 to 1 mole (M), hexamethylenetetramine of 0.1 to 1 mole (M), and remainder of water based on total hydrothermal synthetic solution.

The oxide layer formed on the surface of the aluminum exterior part in forming the oxide layer may be formed of nano-sized zirconium oxide ($ZrO_2$) having an average diameter of 100 to 300 nm, so that the oxide layer may be formed to have a thickness of 1 μm or less, and may have a thickness of 800 to 950 nm.

In forming the electrodeposition coating layer, the aluminum exterior part, that is subjected to forming the oxide layer, may be put into and immersed in paint with voltage of 50 to 100V at a temperature of 25 to 35° C. for 1 to 10 minutes, and the electrodeposition coating layer formed in the electrodeposition coating layer may have a thickness of 6 to 12 μm.

The surface treatment method may further include cleaning the surface of the aluminum exterior part, which is subjected to each of the pre-treating, the etching, the forming the oxide layer, and the forming the electrodeposition coating layer, with de-ionized water after performing each of the pre-treating, the etching, the forming the oxide layer, and the forming the electrodeposition coating layer.

DESCRIPTION OF SPECIFIC EMBODIMENTS

The technical terms used in the present disclosure are employed only to illustrate a specific example and, unless otherwise defined, should be interpreted as the meaning which is generally understood by one of ordinary skill in the art to which the present disclosure pertains, and should not be interpreted in an overly broad sense or an overly narrow sense.

In addition, the singular forms employed herein include the plural forms unless the context clearly indicates otherwise. The terms "constitutes" or "comprises" and the like employed herein should not be interpreted as necessarily including all of several components or several steps described herein, and should be interpreted as meaning that some components or some may not be included or as being capable of further including additional components or steps.

Hereinafter, the present disclosure will be described in detail with reference to the accompanying drawings. However, an exemplary embodiment described herein is merely one example, and one skilled in the art may implement the present disclosure in various different forms, and so the present disclosure is not limited to the exemplary embodiment described herein.

Figure 1:
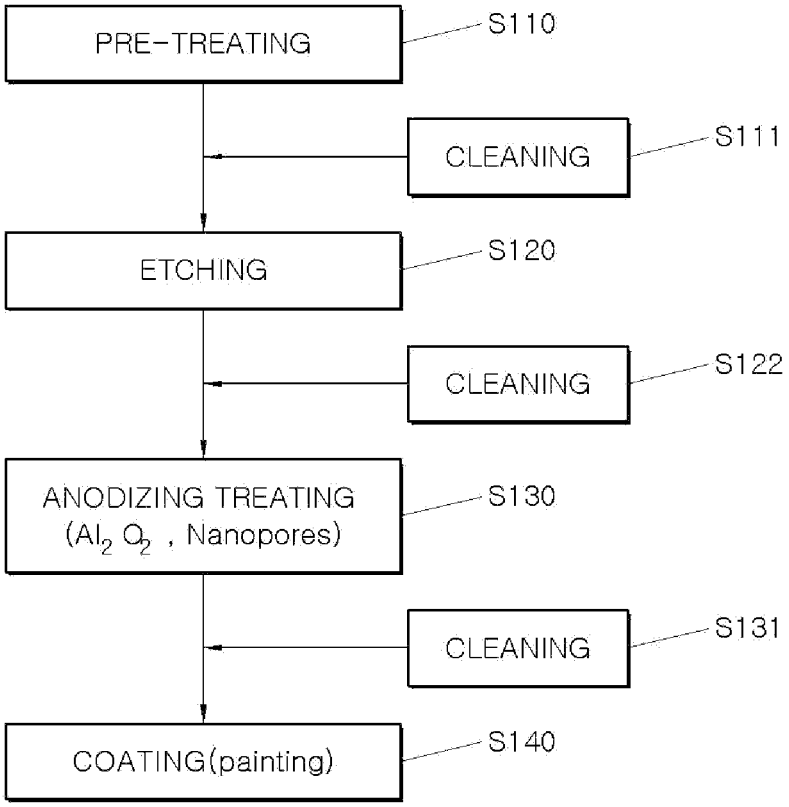
FIG.1(Prior Art)
FIG. 1 schematically shows a flow chart of a conventional surface treatment method for an aluminum exterior part.
Figure 2:
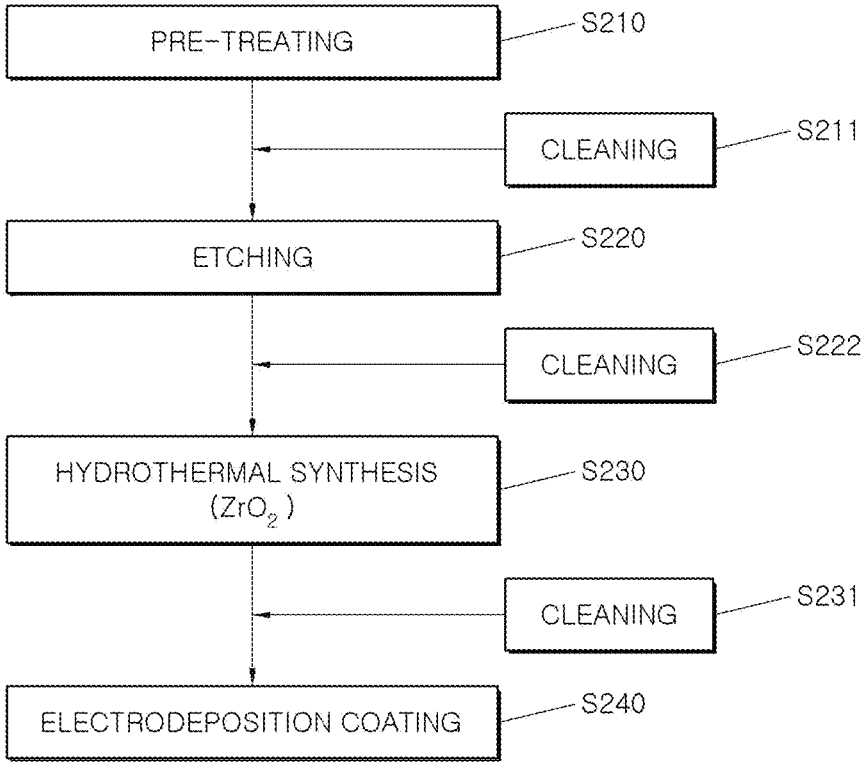
FIG. 2 is a flow chart illustrating a surface treatment method for an aluminum exterior part in accordance with the present disclosure.
Figure 3:
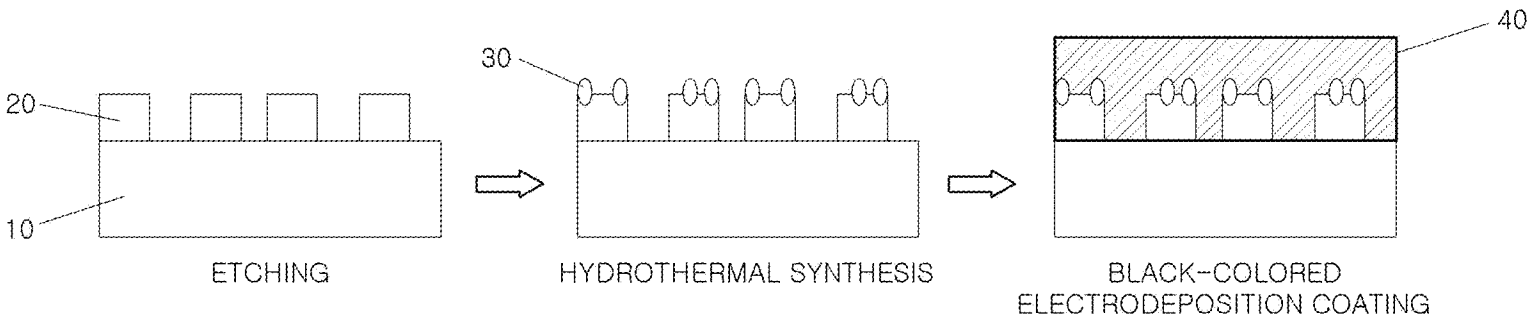
FIG. 3 is a schematic view illustrating the surface treatment method for an aluminum exterior part in accordance with the present disclosure.

As illustrated in the flow charts of FIGS. 2 and 3, a surface treatment method for an exterior part of a vehicle according to the present disclosure includes a pre-treating step S210, and an etching step S220, a hydrothermal synthesizing step S230, and an electro deposition coating step S240.

As illustrated in FIG. 3, according to the surface treatment method for the aluminum exterior part of a vehicle of the present disclosure, a base material 10 of the aluminum exterior part of a vehicle is subjected to the etching step S220 to form a rough etching surface 20 on a surface of the base material which was etched through the etching step S220, an oxide layer 30 formed of nano-oxide is formed on the etching surface 20 through the hydrothermal synthesizing step S230, and an electrodeposition coating layer 40 is formed on the oxide layer.

Specifically, the pre-treating step S210 is the step of removing foreign substance remained on a surface of the aluminum exterior part of a vehicle including aluminum or an aluminum alloy, and for example, the foreign substance may be degreased by immerging the aluminum exterior part in a degreasing solution. However, the present disclosure is not necessarily limited thereto, and a person skilled in the art to which the present disclosure pertains can apply various methods to remove the foreign substance remained on the surface.

The etching step S220 is the procedure in which the aluminum exterior part for a vehicle, that was subjected to the pre-treating step S210, is immersed in an etching solution that is a solution in which water and sulfuric acid ($H_2SO_4$) are mixed in the volume ratio of 3:1, to etch the surface of the aluminum exterior part for a vehicle.

In order to evaluate an adhesive property of a coating layer according to concentrations of the etching solution and etching times, the concentration of the etching solution and the etching time were changed as shown in Tables 1 and 2 below, and the surface treatments according to the present disclosure for the aluminum specimens were then performed. Subsequently, the aluminum specimen on which the electrodeposition coating layer was formed was scratched with a knife to form longitudinal lines and transverse lines thereon, and a tape was attached on a scratched region of the surface of the aluminum specimen and then pulled with a constant force to confirm the number of damaged portions of the surface of the aluminum specimen. Results of the above evaluation are indicated in Tables 1 and 2 and FIGS. 5 and 6.

Specifically, the etching solution in which water and sulfuric acid ($H_2SO_4$) were mixed in the volume ratio of 3:1 was mixed with water to prepare the etching solutions having the concentrations 10 wt %, 15 wt %, 20 wt %, 25 wt %, 30 wt %, 35 wt % %, 45 wt %, and 50 wt %, respectively, and the aluminum specimens were treated with the etching solutions for 5 minutes. The results are indicated in Table 1, and Table 2 shows the results of treating the specimens under the same concentration of the etching solution of 30 wt % and the changed etching time.

TABLE 1

| | Concentration (weight %) | | | | | | | | |
|---|---|---|---|---|---|---|---|---|---|
| | 10 | 15 | 20 | 25 | 30 | 35 | 40 | 45 | 50 |
| The number of damaged portions | 10 | 8 | 6 | 6 | 3 | 3 | 3 | 4 | 5 |

TABLE 2

| Time (min.) | 1 | 2 | 3 | 4 | 5 | 6 | 7 | 8 | 9 |
|---|---|---|---|---|---|---|---|---|---|
| The number of damaged portions | 10 | 8 | 7 | 5 | 3 | 3 | 4 | 4 | 4 |

As shown in above Tables 1 and 2, when the concentration of the etching solution in which water and sulfuric acid ($H_2SO_4$) were mixed in the volume ratio of 3:1 were 30 wt %, 35 wt %, and 40 wt %, the number of the damaged portion was 3, which is the lowest damage degree. In addition, when the etching times were 5 minutes and 6 minutes, the number of the damaged portion was 3, which is the lowest damage degree.

Figure 5:
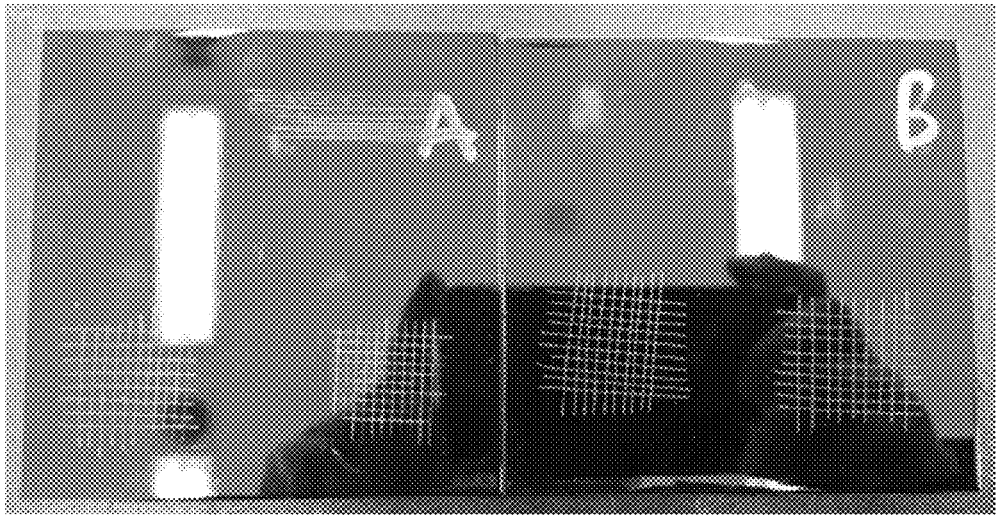
FIGS. 5 and 6 are photographs of surfaces of the aluminum specimens, which are taken by the scanning electron microscope, according to concentrations of etching solution and etching times according to one exemplary embodiment of the present disclosure.
Figure 6:
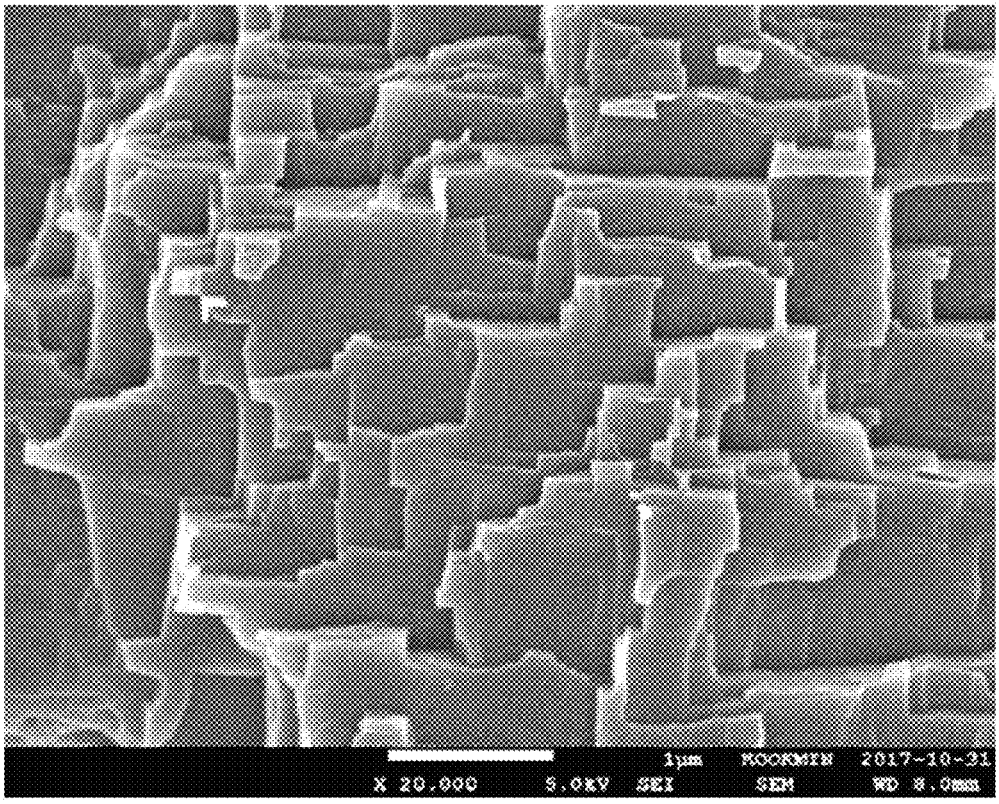

FIGS. 5 and 6 are photographs of the surface of the aluminum specimen, which are taken by the scanning electron microscope, according to concentrations of the etching solution and etching times according to one exemplary embodiment of the present disclosure. In particular, FIG. 5 is a photograph of the surface of the aluminum specimen after having been immersed in the etching solution having the concentration of 30 wt % for 5 minutes, and FIG. 6 is a photograph of the surface of the aluminum specimen after having been immersed in the etching solution having the concentration of 30 wt % for 7 minutes.

When comparing the aluminum specimens of FIGS. 5 and 6, it could be confirmed that when the aluminum specimen was immersed in the etching solution having the concentration of 30 wt % for 5 minutes, the aluminum surface was finely etched to obtain a largest surface area.

In the etching step S220, accordingly, the aluminum exterior part for a vehicle may be immersed in the etching solution having the concentration of 30 to 40 wt % for 5 to 6 minutes at a temperature of 15 to 30° C. More specifically, the aluminum exterior part may be immersed in the etching solution having 30 wt % for 5 minutes.

The hydrothermal synthesizing step S230 is the step in which the aluminum exterior part for a vehicle which was subjected to the etching step S220 is immersed in a hydrothermal synthetic solution to form an oxide layer on the surface of the aluminum exterior part for a vehicle, and the hydrothermal synthesis is a process in which material is synthesized by water of a high temperature.

In order to evaluate an adhesive property of the coating layer according to temperature condition of the hydrothermal synthesis and time condition of the hydrothermal synthesis, a temperature of the hydrothermal synthesis and the time of the hydrothermal synthesis were changed, and the aluminum specimen, on which a surface treatment of the present disclosure was performed and on which the coating layer was formed, was then scratched with a knife to form longitudinal lines and transverse lines thereon, and a tape was attached on a scratched region of the surface of the aluminum specimen and then pulled with a constant force to confirm the number of damaged portions of the surface of the aluminum specimen. Results of the above evaluation are indicated in Tables 3 and 4 and FIGS. 7 and 8.

Specifically, the specimens immersed in the etching solution having the concentration of 30 wt % and subjected to the etching step for 5 minutes were employed as the aluminum specimens, Table 3 shows the results of treating the specimens under the same hydrothermal synthesis time of 5 minutes and changed hydrothermal synthesis temperatures, and Table 4 shows the results of treating the specimens under the same hydrothermal synthesis temperature of 90° C. and the changed hydrothermal synthesis times. In Table 4, the term "non-treated" means that the hydrothermal synthesis is not performed, and the term "anodization" means that an anodizing treatment method is performed instead of the hydrothermal synthesis.

TABLE 3

| | Temperature (° C.) | | | | | | | | |
|---|---|---|---|---|---|---|---|---|---|
| | 50 | 70 | 80 | 90 | 100 | 110 | 120 | 130 | 140 |
| The number of damaged portions | 3 | 3 | 3 | N/A | N/A | 2 | 2 | 2 | 2 |

TABLE 4

| Time (Min.) | Non-treated | Anodization | 1 | 2 | 3 | 4 | 5 | 6 | 7 | 8 | 9 |
|---|---|---|---|---|---|---|---|---|---|---|---|
| The number of damaged portions | 10 | 5 | 3 | 3 | 3 | 3 | N/A | N/A | 2 | 2 | 2 |

As shown in Tables 3 and 4, it was confirmed that when the hydrothermal synthesis was performed at the temperatures 90° C. and 100° C. for 5 minutes, the specimen was not damaged and when the hydrothermal synthesis was performed at the temperature of 90° C. for 5 minutes, the specimen was not damaged.

Figure 7:
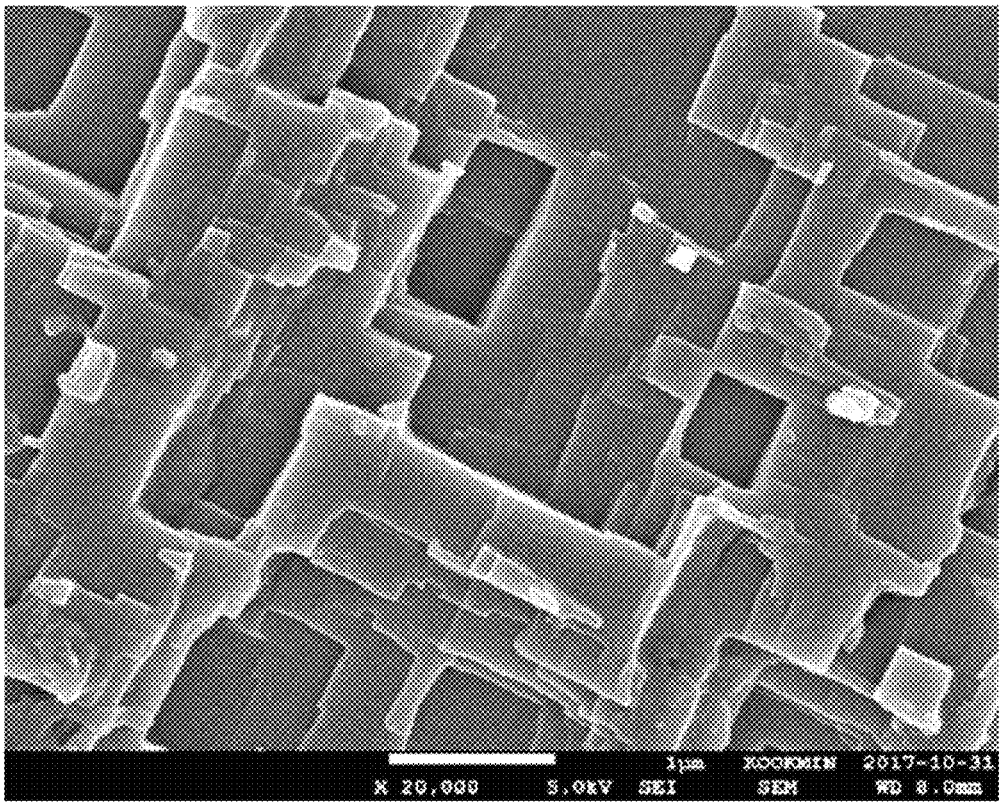
FIGS. 7 and 8 are photographs of the surfaces of the aluminum specimens, which are taken by the scanning electron microscope, according to temperatures and time conditions of hydrothermal synthesis according to one exemplary embodiment of the present disclosure.
Figure 8:
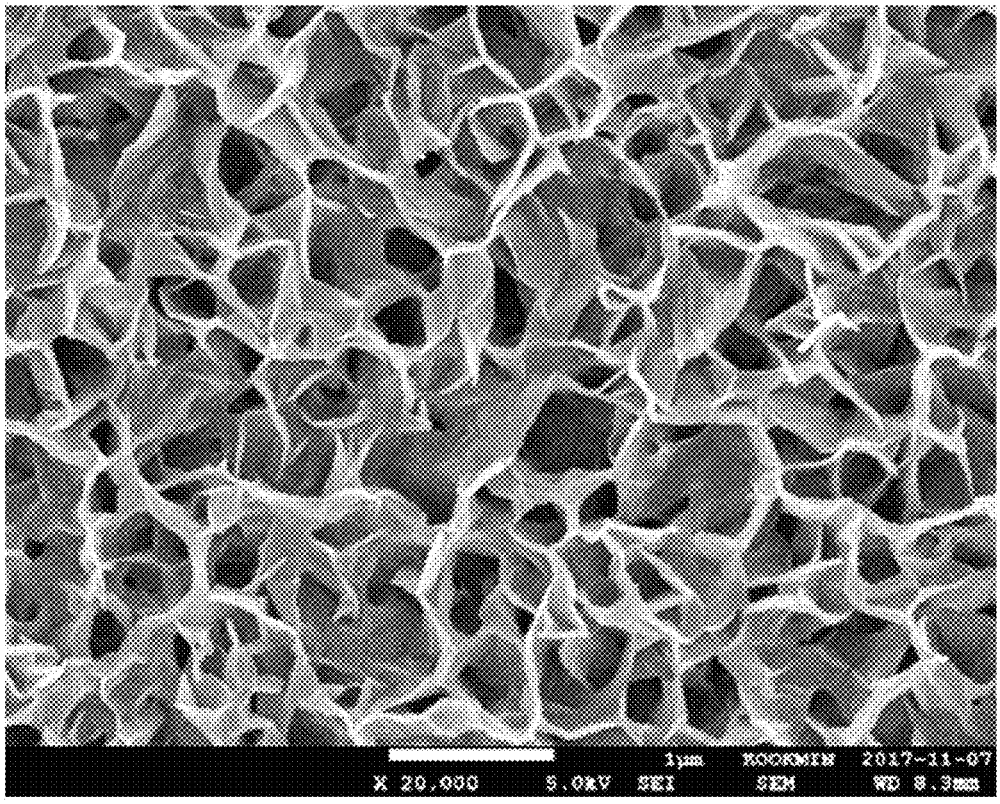

FIGS. 7 and 8 are photographs of the surfaces of the aluminum specimens, which are taken by the scanning electron microscope, according to the temperatures and time conditions of the hydrothermal synthesis according to one exemplary embodiment of the present disclosure. In particular, FIG. 7 shows the surface of the aluminum specimen hydrothermally synthesized at the temperature of 135° C. for 5 minutes, and FIG. 8 shows the surface of the aluminum specimen hydrothermally synthesized at the temperature of 50° C. for 9 minutes.

Comparing the aluminum specimens shown in FIGS. 7 and 8, it could be found that that when hydrothermal synthesis was conducted at the temperature of 135° C. for 5 minutes, oxide was finely synthesized on the surface of aluminum to increase the surface area.

Figure 9:
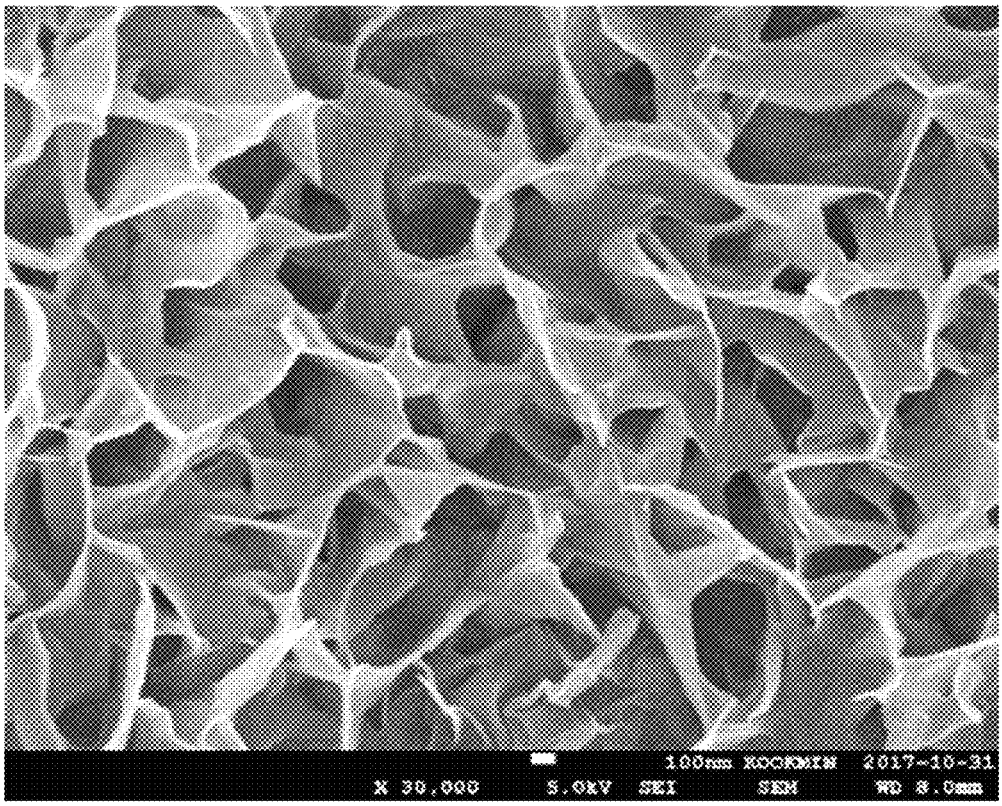
FIG. 9 is a view showing results after performing experimental evaluation for an adhesive property of electrodeposition coating layers of an aluminum specimen, which is surface-treated by an anodizing treatment method, and the aluminum specimen, which is surface-treated according to one exemplary embodiment of the present disclosure.

FIG. 9 is a view showing results after performing experimental evaluation for an adhesive property of an electrodeposition coating layer of an aluminum specimen, which was surface-treated by an anodizing treatment method, and the aluminum specimen, which was surface-treated according to one exemplary embodiment of the present disclosure.

Figure 10:
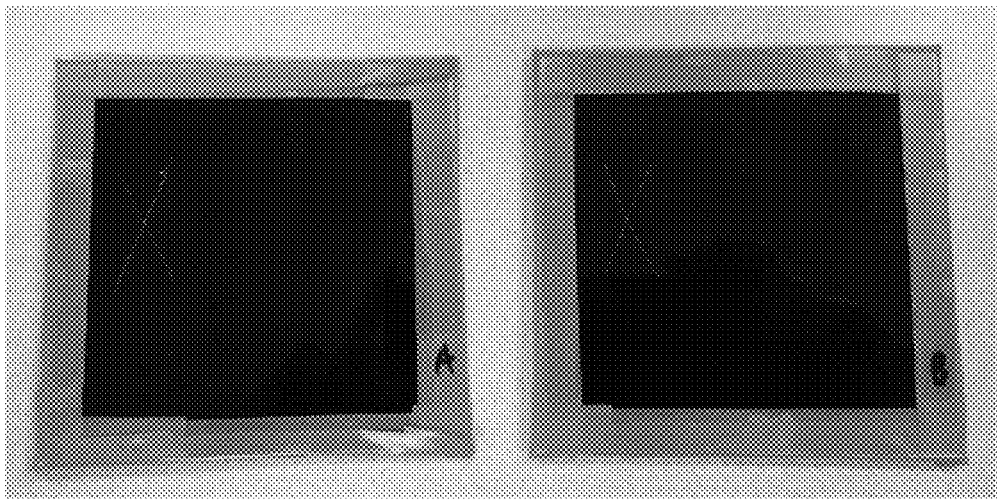
FIG. 10 is a view showing results of observing whether corrosion has been generated after performing experimental evaluation for corrosion resistance of the electrodeposition coating layers of the aluminum specimen, which is surface-treated by the anodizing treatment method, and the aluminum specimen, which is surface-treated according to one exemplary embodiment of the present disclosure.

FIG. 10 is a view showing results of observing whether corrosion has been generated after performing experimental evaluation for corrosion resistance of the electrodeposition coating layers of the aluminum specimen, which is surface-treated by the anodizing treatment method, and the aluminum specimen, which is surface-treated according to one exemplary embodiment of the present disclosure. In FIG. 10, "A" represents the aluminum specimen on which the electrodeposition coating layer is formed by performing a surface treatment using the anodizing treatment method, and "B" represents the aluminum specimen on which the electrodeposition coating layer is formed by a surface treatment therefor through the etching step S220, in which the aluminum specimen is immersed in the etching solution having the concentration of 30 wt % for 5 minutes, and the hydrothermal synthesizing step S230, in which the aluminum specimen is immersed in the hydrothermal synthetic solution at the temperature of 135° C. for 5 minutes, according to the present disclosure.

In order to evaluate the corrosion resistance according to particles of nano oxide formed on the aluminum surface through the hydrothermal synthesis in the hydrothermal synthesizing step S230, zinc oxide (ZnO), chromium oxide ($CrO_3$), and zirconium oxide ($ZrO_2$), which are corrosion-resistant material, were formed by hydrothermal synthesis with hydrothermal synthetic solutions to which zinc (Zn), chromium (Cr) and zirconium (Zr), which are corrosion-resistant material, were applied, respectively, ten X-shaped cutout portions were formed on the surface-treated specimen with a knife, and a salt spray evaluation was then conducted. The results thereof indicate in Table 5 and FIG. 10.

TABLE 5

| Classification | Non-treated | Anodization | Zn | Zr | Cr |
|---|---|---|---|---|---|
| The number of corroded portions | 10 | 8 | 4 | 0 | 4 |

FIG. 10 is a view showing results of observing whether corrosion has been generated after performing experimental evaluation for corrosion resistance of the electrodeposition coating layers of the aluminum specimen, which was surface-treated by the anodizing treatment method, and the aluminum specimen, which was surface-treated according to one exemplary embodiment of the present disclosure. In FIG. 10, "A" represents the aluminum specimen on which the electrodeposition coating layer is formed by performing a surface treatment using the anodizing treatment method, and "B" represents the aluminum specimen on which the electrodeposition coating layer is formed by a surface treatment therefor through the etching step S220, in which the aluminum specimen is immersed in the etching solution having the concentration of 30 wt % for 5 minutes, and the hydrothermal synthesizing step S230, in which the aluminum specimen is immersed in the hydrothermal synthetic solution, to which zirconium (Zr) is applied, at the temperature of 135° C. for 5 minutes, according to the present disclosure.

As shown in Table 5 and FIG. 10, it could be confirmed that corrosion was not generated at all in the hydrothermal synthetic solution containing zirconium (Zr), so that this aluminum specimen had the best corrosion resistance.

Therefore, the hydrothermal synthetic solution used in the hydrothermal synthesizing step S230 of the present disclosure may contain zirconium nitrate ($Zr(NO_3)_4$) of 0.1 to 1 mole (M), hexamethylenetetramine of 0.1 to 1 mole (M) and remainder of water based on total hydrothermal synthetic solution.

Hydrothermal synthesis reaction conducted at 90° C. using the above described hydrothermal synthetic solution can form nano-sized zirconium oxide ($ZrO_2$) having an average diameter of 100 to 300 nm as an oxide through a reaction as shown in the following reaction formula 1.

$$Zr(NO_3)_4+2H_2O \rightarrow ZrO_2+4HNO_3 \quad \text{[Reaction formula 1]}$$

Figure 4:
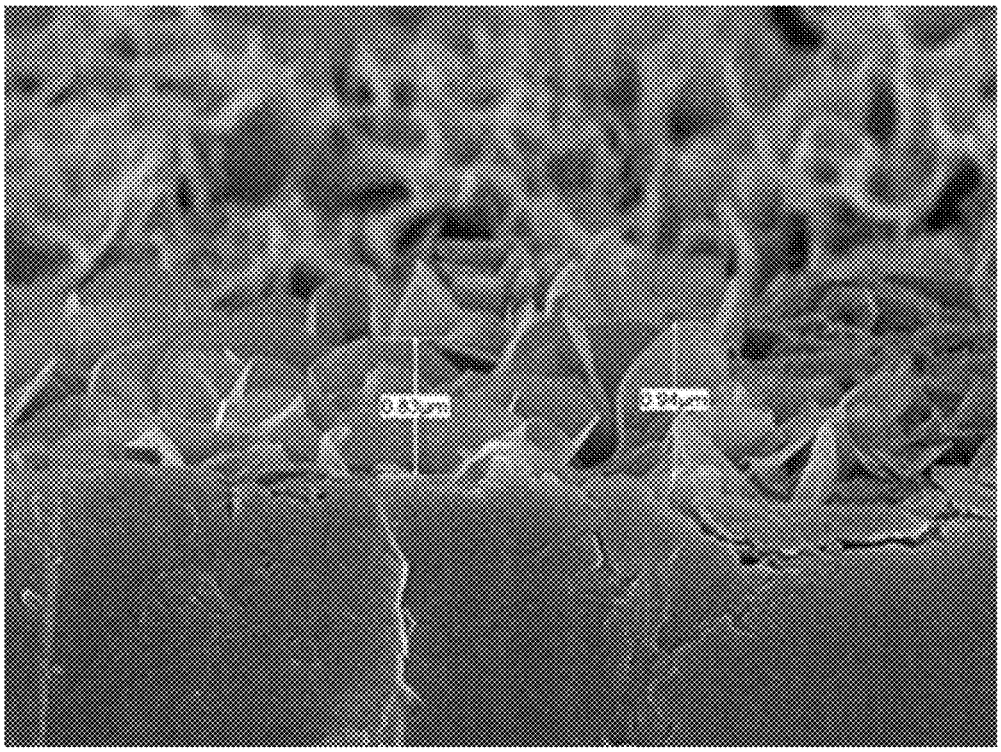
FIG. 4 is a photograph of a cross section of an aluminum material specimen, which is taken by a scanning electron microscope (SEM), after a hydrothermal synthesizing step in the surface treatment method for the aluminum exterior part in accordance with the present disclosure.

FIG. 4 is a photograph of a cross section of the aluminum material specimen, which is taken by a scanning electron microscope (SEM), after the hydrothermal synthesizing step in the surface treatment method for the aluminum exterior part in accordance with the present disclosure. As shown in FIG. 4, it could be confirmed that the oxide layer formed on the aluminum surface has a thickness of 800 to 950 nm, which is equal to or less than 1 μm.

The electrodeposition coating step S240 is the step of forming the electrodeposition coating layer on the surface of aluminum exterior part for a vehicle, which was subjected to the hydrothermal synthesizing step S230.

The aluminum exterior part having the surface area previously improved through the etching step S220 and the hydrothermal synthesizing step S230 is put into and immersed in paint with voltage of 50 V to 100 V at a temperature of 25 to 35° C. for 1 to 10 minutes.

The electrodeposition coating layer formed on the surface of the aluminum exterior part for a vehicle through the electrodeposition coating step as above may have a thickness of 6 to 12 μm.

Figure 11A:
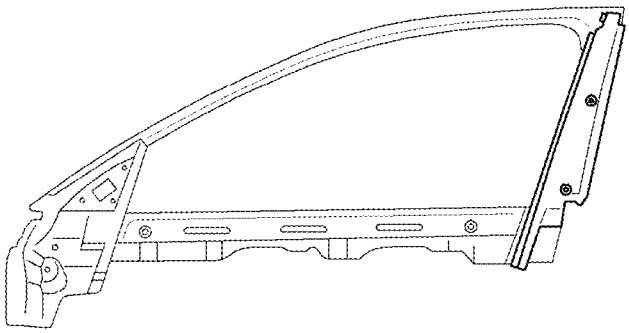
FIGS. 11A and 11B are views illustrating a real door frame garnish to which the surface treatment method for the aluminum exterior part of a vehicle in accordance with the present disclosure is applied.
Figure 11B:
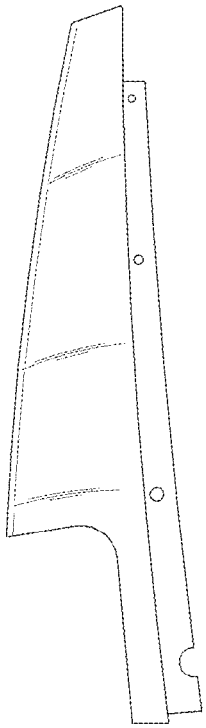

FIGS. 11A and 11B are views illustrating a real door frame garnish to which the surface treatment method for the aluminum exterior part of a vehicle in accordance with the present disclosure is applied.

As a result of performing the surface treatment for the aluminum exterior part for a vehicle under the conditions as described in the foregoing embodiment, it can be confirmed that, as compared with the aluminum exterior part of a vehicle to which the conventional anodizing treatment method is applied, the aluminum exterior part exhibits excellent physical properties of the coating layer, such as an adhesive property, corrosion resistance, and the like.

According to the surface treatment method for the aluminum exterior parts of a vehicle of the present disclosure as described above, by treating the surface of the aluminum exterior part through the hydrothermal synthesis method, as compared with the aluminum exterior part of a vehicle to which the conventional anodizing treatment method is applied, physical properties of the coating layer of the aluminum exterior part, such as an adhesive property, corrosion resistance, and the like are improved.

In addition, since there is no need for a separate device or the like required for the anodizing treatment method and the surface of the aluminum exterior part for a vehicle can be treated within a process time of 10 minutes or less, it is possible to significantly improve workability and productivity, to secure an efficient work space and to reduce investment of facility and equipment, thus lowering the production cost.

Although the present disclosure has been described with a focus on novel features of the present disclosure applied to various embodiments, it will be apparent to those skilled in the art that various deletions, substitutions, and changes in the form and details of the apparatus and method described above may be made without departing from the scope of the present disclosure. Accordingly, the scope of the present disclosure is defined by the appended claims rather than by the foregoing description. All modifications within the equivalent scope of the appended claims are embraced within the scope of the present disclosure.

What is claimed is:

1. A surface treatment method for an aluminum exterior part of a vehicle, comprising:

pre-treating the aluminum exterior part comprising aluminum or an aluminum alloy;

etching a surface of the pre-treated aluminum exterior part by immersing the pre-treated aluminum exterior part in an etching solution;

forming an oxide layer on the surface of the aluminum exterior part by immersing the aluminum exterior part, which is subjected to the etching, in a hydrothermal synthetic solution; and forming an electrodeposition coating layer on the surface of the aluminum exterior part, which is subjected to the forming the oxide layer, wherein the hydrothermal synthetic solution contains zirconium nitrate ($Zr(NO_3)_4$) of 0.1 to 1 mole (M), hexamethylenetetramine of 0.1 to 1 mole (M), and remainder of water based on a total hydrothermal synthetic solution.

2. The method of claim 1, wherein, in the etching, the aluminum exterior part is put into and immersed in the etching solution at a temperature of 15 to 30° C. for 1 to 10 minutes.

3. The method of claim 1, wherein the etching solution includes water and sulfuric acid ($H_2SO_4$) in a volume ratio of 3:1.

4. The method of claim 3, wherein the etching solution has a concentration of 30 to 40 wt %.

5. The method of claim 1, wherein, in forming the oxide layer, the aluminum exterior part, which is subjected to the etching, is put into and immersed in the hydrothermal synthetic solution at a temperature of 90 to 100° C. for 1 to 10 minutes.

6. The method of claim 1, wherein, in forming the oxide layer, the oxide layer formed on the surface of the aluminum exterior part includes nano-sized zirconium oxide ($ZrO_2$) having an average diameter of 100 to 300 nm.

7. The method of claim 1, wherein the oxide layer formed in the oxide layer has a thickness of 1 μm or less.

8. The method of claim 1, wherein, in forming the electrodeposition coating layer, the aluminum exterior part, that is subjected to the forming the oxide layer, is put into and immersed in paint with voltage of 50 to 100V at a temperature of 25 to 35° C. for 1 to 10 minutes.

9. The method of claim 1, wherein the electrodeposition coating layer formed in the electrodeposition coating layer has a thickness of 6 to 12 μm.

10. The method of claim 1, further comprising cleaning the aluminum exterior part, which is subjected to each of the pre-treating, the etching, the forming the oxide layer, and the forming the electrodeposition coating layer, with de-ionized water after performing each of the pre-treating, the etching, the forming the oxide layer, and the forming the electrodeposition coating layer.

* * * * *